US008061423B2

(12) United States Patent
Lohbeck

(10) Patent No.: US 8,061,423 B2
(45) Date of Patent: Nov. 22, 2011

(54) EXPANDABLE WELLBORE ASSEMBLY

(75) Inventor: Wilhelmus Christianus Maria Lohbeck, Nootdorp (NL)

(73) Assignee: Shell Oil Company, Houston, TX (US)

( * ) Notice: Subject to any disclaimer, the term of this patent is extended or adjusted under 35 U.S.C. 154(b) by 826 days.

(21) Appl. No.: 10/574,132

(22) PCT Filed: Oct. 1, 2004

(86) PCT No.: PCT/EP2004/052402

§ 371 (c)(1),
(2), (4) Date: Mar. 30, 2006

(87) PCT Pub. No.: WO2005/031115

PCT Pub. Date: Apr. 7, 2005

(65) Prior Publication Data

US 2007/0068671 A1 Mar. 29, 2007

(30) Foreign Application Priority Data

Oct. 1, 2003 (EP) ..... 03103632

(51) Int. Cl.
*E21B 29/10* (2006.01)
*F16L 13/14* (2006.01)
*F16L 19/04* (2006.01)

(52) U.S. Cl. ..... 166/277; 166/207; 166/384; 285/382; 285/382.4; 285/382.5

(58) Field of Classification Search ..... 285/382, 285/382.4, 382.5; 166/207, 277, 384
See application file for complete search history.

(56) References Cited

U.S. PATENT DOCUMENTS

| | | | | |
|---|---|---|---|---|
| 5,348,095 | A * | 9/1994 | Worrall et al. | 166/380 |
| 5,366,012 | A * | 11/1994 | Lohbeck | 166/277 |
| 5,667,011 | A * | 9/1997 | Gill et al. | 166/295 |
| 6,098,717 | A * | 8/2000 | Bailey et al. | 166/382 |
| 6,315,040 | B1 * | 11/2001 | Donnelly | 166/207 |
| 6,431,282 | B1 * | 8/2002 | Bosma et al. | 166/288 |
| 6,454,493 | B1 * | 9/2002 | Lohbeck | 405/184.2 |
| 6,457,533 | B1 * | 10/2002 | Metcalfe | 166/381 |
| 6,607,220 | B2 * | 8/2003 | Sivley, IV | 285/334 |
| 6,719,064 | B2 * | 4/2004 | Price-Smith et al. | 166/387 |
| 6,799,637 | B2 * | 10/2004 | Schetky et al. | 166/384 |
| 6,896,052 | B2 * | 5/2005 | Simpson et al. | 166/207 |
| 6,904,974 | B2 * | 6/2005 | Slack | 166/384 |

(Continued)

FOREIGN PATENT DOCUMENTS

WO 03/006789 1/2003

(Continued)

OTHER PUBLICATIONS

"Poisson's ratio"—Wikipedia, 8 pages.*

(Continued)

*Primary Examiner* — Jennifer H Gay

(57) ABSTRACT

An assembly for use in a wellbore formed in an earth formation, comprising an expandable tubular element and an outer structure having first and second portions arranged at a distance from each other, the portions being restrained to the tubular element in a manner that the distance changes as a result of radial expansion of the tubular element, the outer structure further having a third portion arranged to move radially outward upon said change in distance between the first and second portions, wherein said radially outward movement of the third portion is larger than the radially outward movement of the tubular element as a result of radial expansion of the tubular element.

13 Claims, 5 Drawing Sheets

U.S. PATENT DOCUMENTS

| | | | | |
|---|---|---|---|---|
| 7,048,048 | B2 * | 5/2006 | Nguyen et al. | 166/227 |
| 7,055,597 | B2 * | 6/2006 | Lauritzen | 166/207 |
| 7,096,939 | B2 * | 8/2006 | Kirk et al. | 166/241.6 |
| 7,104,323 | B2 * | 9/2006 | Cook et al. | 166/278 |
| 7,172,027 | B2 * | 2/2007 | Simpson et al. | 166/382 |
| 7,234,533 | B2 * | 6/2007 | Gambier | 166/387 |
| 7,299,882 | B2 * | 11/2007 | Brezinski et al. | 166/387 |
| 7,398,831 | B2 * | 7/2008 | Schetky et al. | 166/380 |
| 7,404,437 | B2 * | 7/2008 | Brezinski et al. | 166/179 |
| 2002/0092658 | A1 | 7/2002 | Johnson et al. | |
| 2002/0112888 | A1 | 8/2002 | Leuchtenberg | |
| 2002/0139540 | A1 * | 10/2002 | Lauritzen | 166/387 |
| 2002/0189696 | A1 * | 12/2002 | Simpson et al. | 138/89 |
| 2003/0062170 | A1 * | 4/2003 | Slack | 166/377 |
| 2004/0055758 | A1 * | 3/2004 | Brezinski et al. | 166/384 |
| 2004/0060695 | A1 * | 4/2004 | Castano-Mears et al. | 166/228 |
| 2004/0065445 | A1 * | 4/2004 | Abercrombie Simpson et al. | 166/382 |
| 2004/0148758 | A1 * | 8/2004 | Lohbeck et al. | 29/523 |
| 2004/0173361 | A1 * | 9/2004 | Lohbeck | 166/384 |
| 2005/0000692 | A1 * | 1/2005 | Cook et al. | 166/300 |
| 2005/0092485 | A1 * | 5/2005 | Brezinski et al. | 166/207 |

FOREIGN PATENT DOCUMENTS

| | | |
|---|---|---|
| WO | 03/008760 | 1/2003 |

OTHER PUBLICATIONS

Seibi et al., "Structural Behavior of a Solid Tubular Under Large Radial Plastic Expansion" Dec. 2005, Journal of Energy Resources Technology, vol. 127, pp. 323-327.*

International Search Report dated Jan. 3, 2005 (PCT/EP2004/052402).

* cited by examiner

Fig.3A.
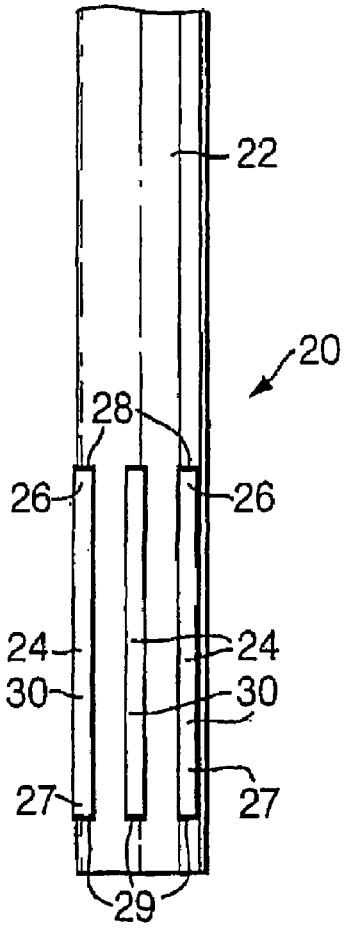
Fig.3B.
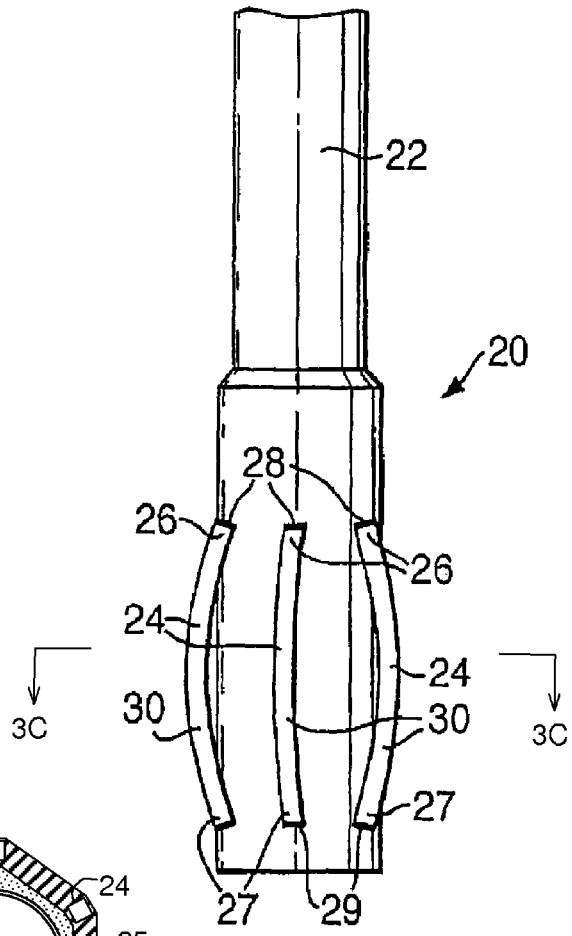
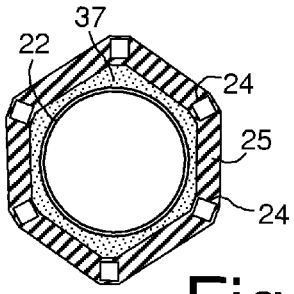
Fig. 3C

EXPANDABLE WELLBORE ASSEMBLY

The present application claims priority on European Patent Application 03103632.0 filed Oct. 1, 2003.

FIELD OF THE INVENTION

The present invention relates to an assembly for use in a wellbore formed in an earth formation, the assembly comprising an expandable tubular element.

BACKGROUND OF THE INVENTION

In the industry of wellbore construction for the exploitation of hydrocarbon fluid from earth formations, expandable tubular elements find increasing application. A main advantage of expandable tubular elements in wellbores relates to the increased available internal diameter downhole for fluid production or for the passage of tools, compared to conventional wellbores with a nested casing scheme. Generally, an expandable tubular element is installed by lowering the unexpanded tubular element into the wellbore, whereafter an expander is pushed, pumped or pulled through the tubular element. The expansion ratio, being the ratio of the diameter after expansion to the diameter before expansion, is determined by the effective diameter of the expander.

In some applications it is desirable to apply a structure which is locally expanded to a diameter larger than the final diameter as determined by the expansion ratio of the tubular element. Such locally increased expansion diameter can be desired, for example, to create a packer around the expandable tubular element, to create an anchor for anchoring the expanded tubular element to the surrounding rock formation, or to release a triggering fluid. Accordingly there is a need for an expandable tubular element system which provides a locally increased expansion diameter relative to the overall expansion ratio of the tubular element.

SUMMARY OF THE INVENTION

An assembly for use in a wellbore formed in an earth formation, comprising an expandable tubular element and an outer structure having first and second portions arranged at a distance from each other, said portions being restrained to the tubular element in a manner that said distance changes as a result of radial expansion of the tubular element, the outer structure further having a third portion arranged to move radially outward upon said change in distance between the first and second portions, wherein said radially outward movement of the third portion is larger than radially outward movement of the tubular element as a result of radial expansion of the tubular element, wherein the tubular element is susceptible of axial shortening upon radial expansion thereof, and wherein said first and second portions of the outer structure are connected to the tubular element at respective locations axially spaced from each other.

BRIEF DESCRIPTION OF THE DRAWINGS

The present invention is better understood by reading the following description of non-limitative embodiments with reference to the attached drawings, wherein like parts of each of the figures are identified by the same reference characters, and which are briefly described as follows:

FIG. 3A schematically shows a first alternative embodiment of an assembly according to one embodiment of the invention;

FIG. 3B schematically shows the first alternative embodiment during radial expansion of the tubular element thereof;

FIG. 3C is a cross-section taken along lines 3C-3C of FIG. 3B, but showing an alternative embodiment;

DETAILED DESCRIPTION OF THE INVENTION

Figure 1A:
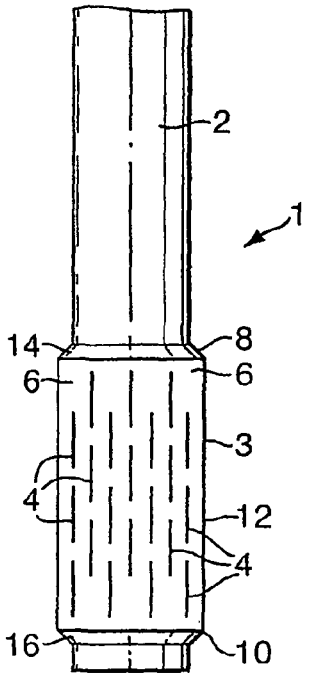
FIG. 1A schematically shows an embodiment of an assembly according to one embodiment of the invention.
Figure 1B:
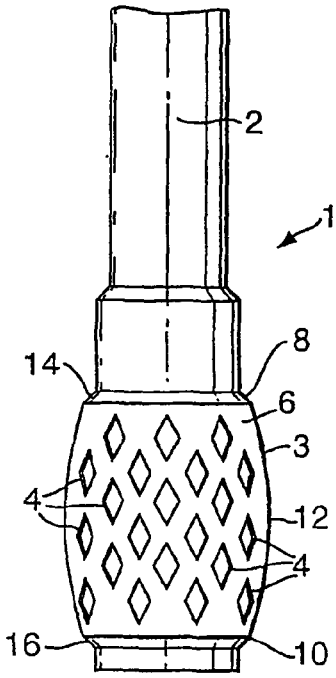
FIG. 1B schematically shows the embodiment of FIG. 1A during radial expansion of the tubular element thereof.

Referring to FIGS. 1A, 1B there is shown a tubular assembly 1 comprising an expandable tubular element 2 susceptible to axial shortening upon radial expansion thereof, and an outer expandable tube 3 arranged around the tubular element 2. The outer tube 3 is provided with a plurality of axially overlapping slots 4 arranged in a pattern of rows 6 whereby the slots 4 of each row 6 are axially aligned, the rows 6 being regularly spaced along the circumference of the outer tube 3, and whereby adjacent rows 6 are staggeredly arranged relative to each other. Hereinafter the outer tube 3 is referred to as an "expandable slotted tube" (EST). By virtue of the pattern of axially overlapping slots 4, the EST 3 is susceptible to significantly less axial shortening than the tubular element 2 upon radial expansion, for equal expansion ratios of the EST 3 and the tubular element 2. The EST 3 has first and second portions in the form of the respective ends 8, 10 of the EST, and a third portion in the form of the middle portion 12 of the EST. The EST 3 is welded to the outer surface of the tubular element 2 at both end portions 8, 10 of the EST by means of respective circumferential welds 14, 16.

During radial expansion of the tubular assembly 1 (FIG. 1B) an expander (not shown) is moved in a longitudinal direction through the interior of the tubular element 2. As shown, the middle portion 12 of the EST 3 bends radially outward from the tubular element 2 as a result of the expansion process. Such outward bending of the middle portion 12 is a consequence of the tendency of the EST 3 to less axial shortening than the tubular element 2 during radial expansion of the tubular assembly 1.

Figure 2A:
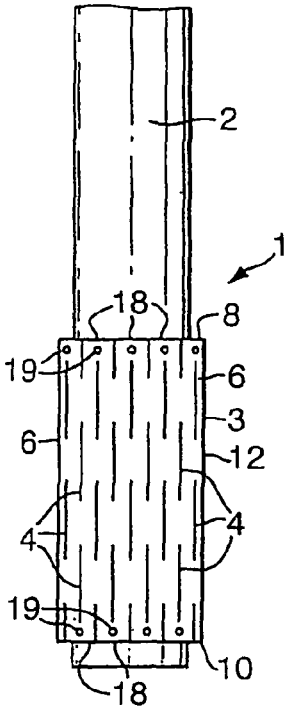
FIG. 2A schematically shows a variation to the embodiment of FIG. 1A.
Figure 2B:
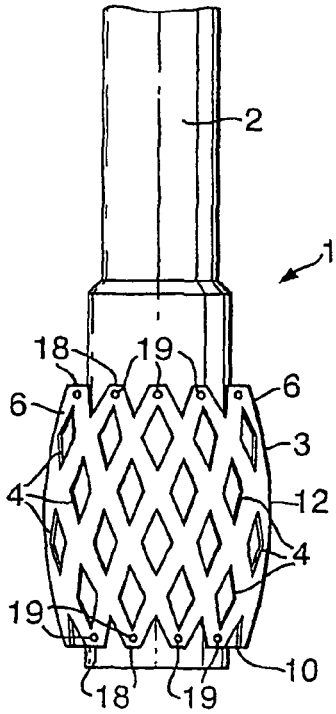
FIG. 2B schematically shows the variation embodiment of FIG. 2A during radial expansion of the tubular element thereof.

In FIGS. 2A, 2B is shown a variation to the embodiment of FIGS. 1A, 1B, whereby the slots 4 nearest the ends 8, 10 of the EST 3 fully extend to the ends 8, 10 thereby forming a plurality of axially extending fingers 18 at said ends 8, 10. The fingers 18 are spot-welded to the tubular element 2 by spot-welds 19. Such spot-welds 19 replace the circumferential welds 14, 16 of the embodiment of FIGS. 1A, 1B. The alternative embodiment has the advantage over the embodiment of FIGS. 1A, 1B that a lower expansion force is required at he location of the respective ends 8, 10 because the fingers 18 are allowed to deflect somewhat during the expansion process.

In FIGS. 3A, 3B is shown a first alternative assembly 20 of an expandable tubular element 22 susceptible of axial shortening upon radial expansion thereof, and an outer structure in the form of a plurality of bars 24 regularly spaced along the circumference of the tubular element 22, each bar 24 extending in a longitudinal direction. Each bar 24 has opposite end portions 26, 27 welded to the outer surface of the tubular element 22 by respective welds 28, 29, and a middle portion 30 located between the end portions 26, 27. Each bar 24 is suitably made of metal, for example a steel such as stainless steel or spring steel.

During radial expansion of the first alternative assembly 20 (FIG. 3B) an expander (not shown) is moved in longitudinal direction through the interior of the tubular element 22. The middle portion 30 of each bar 24 bends radially outward from the tubular element 22 as a result of the expansion process. Such outward bending is a consequence of axial shortening of the tubular element 22 during the expansion process.

In a variation to the embodiment of FIGS. 3A, 3B, shown in FIG. 3C, the bars are embedded in a layer 25 of resilient material, such as elastomer material. In this manner an annular space 37 is formed between the expandable tubular element 22 and the layer 25 of resilient material upon radial expansion of the tubular element. Such annular space can be used, for example, for storage of a fluid. Such fluid can be a hardenable fluid so as to form a packer around the expandable tubular element after hardening of the fluid. Alternatively, layer 25 may be positioned outside of bars 24, rather than the bars being embedded in the resilient layer.

Figure 4A:
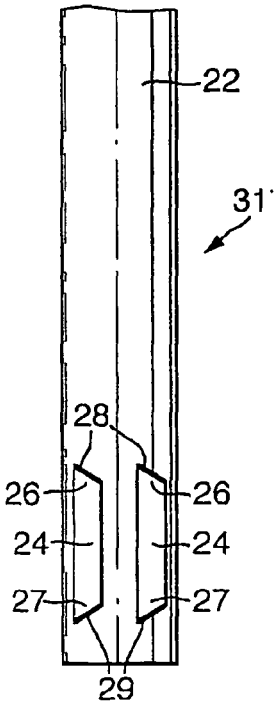
FIG. 4A schematically shows a second alternative embodiment of an assembly according to the invention.
Figure 4B:
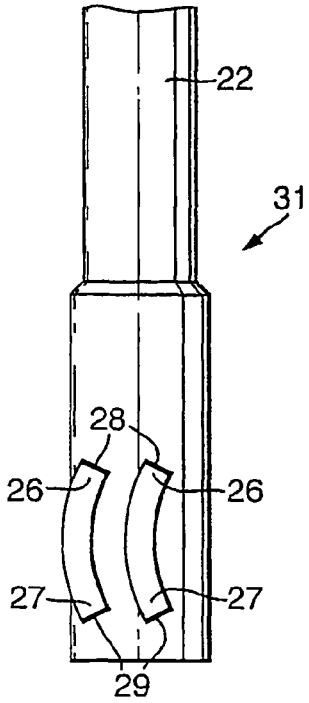
FIG. 4B schematically shows the second alternative embodiment during radial expansion of the tubular element thereof.

In FIGS. 4A, 4B is shown a second alternative assembly 31 which is substantially similar to the assembly 20 of FIGS. 3A, 3B, the difference being the orientation of the welds 28, 29 which extend in the hoop direction in the case of the FIGS. 3A, 3B embodiment, and which extend at an angle to the hoop direction in the case of the second alternative assembly 31.

During radial expansion of the second alternative assembly 31 (FIG. 4B) an expander (not shown) is moved in a longitudinal direction through the interior of the tubular element 22. The middle portion 30 of each bar 24 bends outward from the tubular element 22 due to axial shortening of the tubular element 22. Due to the arrangement whereby the welds 28, 29 extend at an angle to the hoop direction, the direction of outward bending of the middle portion 30 of each bar 24 is skewed relative to the radial direction at the location of the bar 24.

In a variation (not shown) to the embodiment of FIGS. 4A, 4B, only one of the two welds of each bar extends at an angle to the hoop direction, the other one of the welds extending in the hoop direction.

Figure 5A:
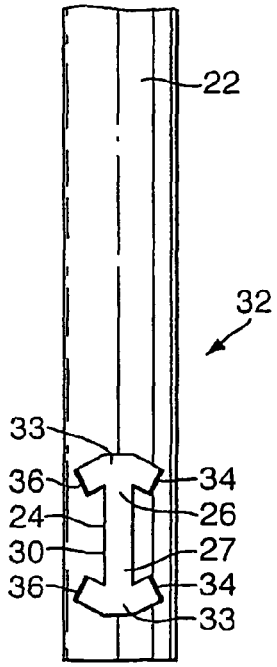
FIG. 5A schematically shows a third alternative embodiment of an assembly according to one embodiment of the invention.
Figure 5B:
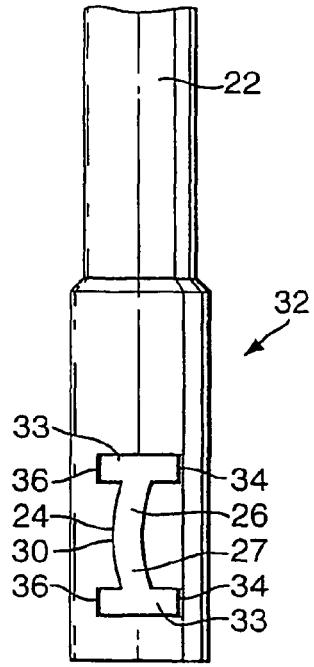
FIG. 5B schematically shows the third alternative embodiment during radial expansion of the tubular element thereof.

In FIGS. 5A, 5B is shown a third alternative assembly 32 which is substantially similar to the assembly 20 of FIGS. 3A, 3B, the difference being that in the second alternative assembly 32 each bar 24 is at the respective end portions 26, 27 thereof connected to the tubular element 22 via curved end members 33 extending in the hoop direction. Each curved end member 33 is at opposite ends thereof welded to the tubular element 22 by respective welds 34, 36.

During radial expansion of the third assembly 32 (FIG. 5B) an expander (not shown) is moved in a longitudinal direction through the interior of the tubular element 22. As a result of the expansion process each end member 33 stretches from its initial curved shape towards a substantially straight shape thereby pushing the end portions 26, 27 of the respective bar 24 towards each other, thereby inducing the middle portion 30 of the bar 24 to bend radially outward. The third alternative embodiment has the advantage that radially outward movement of the middle portion 30 of each bar 24 occurs even if no axial shortening of the tubular element 22 occurs, for example because the tubular element 22 is axially restrained in the wellbore by frictional forces from the wellbore wall.

Figure 6:
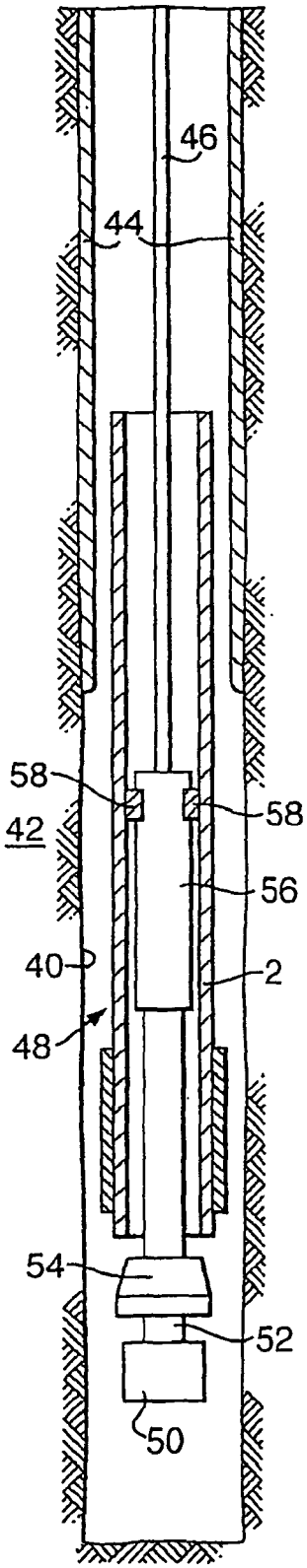
FIGS. 6-9 schematically show a wellbore in which the assembly of FIGS. 1A, 1B has been installed to allow setting of a packer in the tubular element.

Referring further to FIG. 6 there is shown a wellbore 40 formed into an earth formation 42 whereby an upper part of the wellbore 40 is provided with a casing 44. The tubular assembly 1 discussed hereinbefore with reference to FIGS. 1A, 1B is arranged in the wellbore 40 whereby the expandable tubular element 2 of the assembly forms expandable liner 2. The liner 2 is located in the wellbore 40 such that an upper section of the liner 2 extends into a lower end part of the casing 44, and a lower section of the liner 2 extends below the casing 44. The tubular assembly 1 is suspended from the surface by a tubular running string 46 which is at the lower end thereof connected to an expansion assembly 48. The expansion assembly 48 includes the following components, successively in upward direction:

a packer 50 provided with a short connecting string 52, the packer 50 being radially expandable by rotation of a central portion of the packer relative to a radially outer portion of the packer;

a connecting string releasably connecting the packer 50 to a cone expander described hereinafter;

a cone expander 54 movable between a radially collapsed mode and a radially expanded mode; and a hydraulic expansion tool 56 (generally referred to as "force multiplier") suitable to pull the cone expander 54 into the liner 2 so as to radially expand same, the hydraulic expansion tool 56 being provided with retractable anchoring pads 58 for anchoring the hydraulic expansion tool 56 to the inner surface of the liner 2.

The hydraulic expansion tool 56 and the collapsible cone expander 54 are in fluid communication with a hydraulic control system (not shown) at surface via tubular running string 46 so as to allow the control system to induce collapsing or expanding of the collapsible cone expander 54, to induce the hydraulic expansion tool 56 to pull the cone expander 54 through the liner 2, and to induce retracting of the anchoring pads 58.

Figure 7:
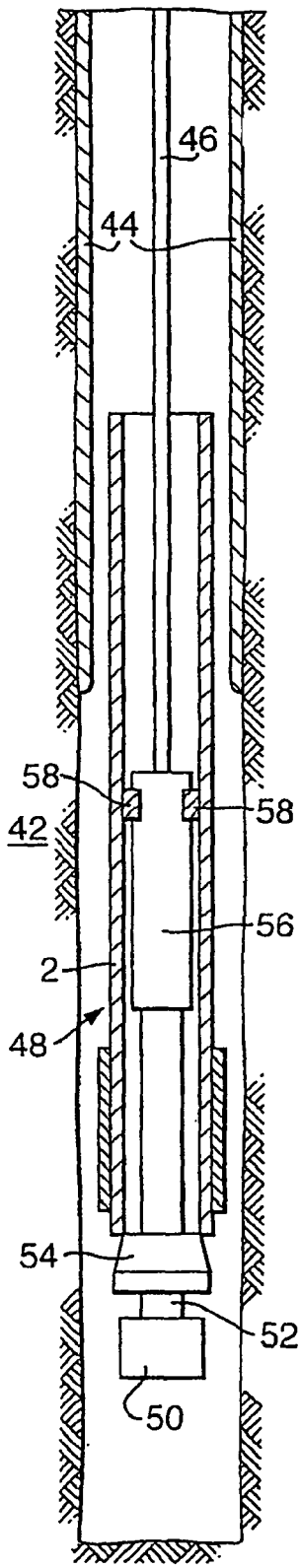
Figure 8:
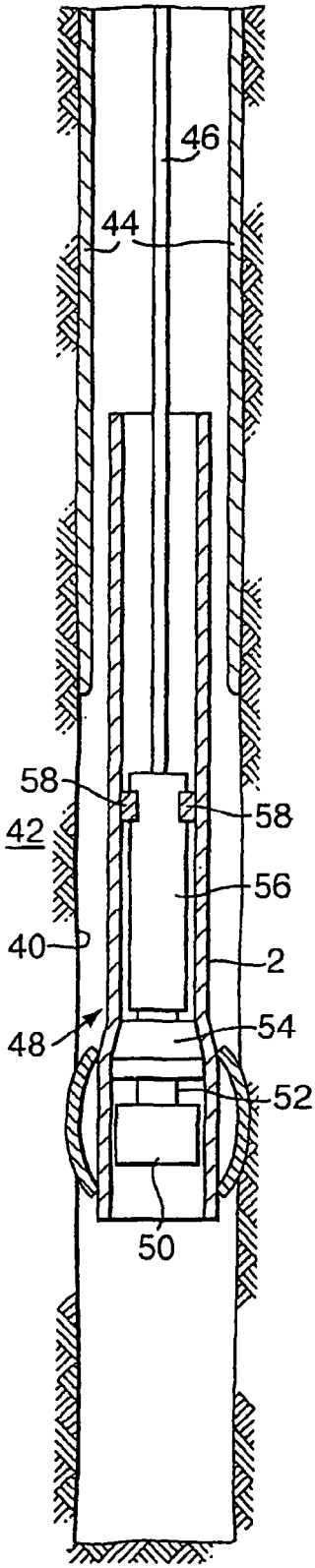
Figure 9:
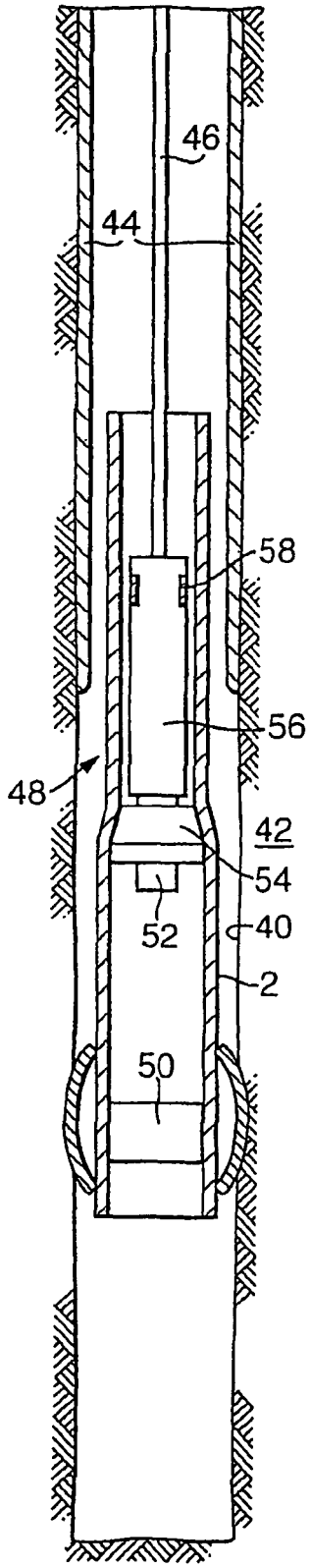

During normal use of the embodiment shown in FIG. 6, the following steps are performed whereby reference is further made to FIGS. 7-9.

Referring to FIG. 7, in a first step of normal use the hydraulic control system is operated to move the cone expander 54 from the radially collapsed mode to the radially expanded mode thereof.

Referring to FIG. 8, in a second step of normal use the control system is operated to firmly anchor the anchoring pads 58 of the hydraulic expansion tool 56 against the inner surface of the liner 2, and to induce the hydraulic expansion tool 56 to pull the cone expander 54 into the lower end part of the liner 2 so as to radially expand same. As explained with reference to FIGS. 1A, 1B, the middle portion 12 of the EST 3 bends radially outward from the tubular element 2 as a result of the expansion process. The EST 3 thereby becomes firmly pressed against the wellbore wall so that the liner 2 is secured against rotation and is suspended from the wellbore wall.

Referring to FIG. 9, in a third step of normal use the hydraulic control system is operated to move the cone expander 54 from the radially expanded mode to the radially collapsed mode thereof, and to induce retraction of the anchoring pads 58 from the inner surface of the liner 2. As a result the hydraulic expansion tool 56 and the cone expander 54 are no longer restrained to the inner surface of the liner 2. Next the central portion of the packer 50 is rotated, by rotating the tubular running string 46 from surface. During such rotation of the central portion of the packer 50, the radially outer portion of the packer 50 is subject to friction along the inner surface of the liner 2 which tends to resist rotation of the outer portion. As a result the central portion of the packer 50 rotates more than the radially outer portion thereof, so that the packer 50 expands gradually against the inner surface of the liner 2 and becomes firmly fixed within the expanded lower end part of the liner 2. During setting of the liner 2, rotation of the liner 2 is prevented by virtue of the EST 3 being firmly pressed against the wellbore wall.

Subsequently the hydraulic control system is operated to move the cone expander 54 back to the radially expanded mode thereof, and to release the packer 50 from the hydraulic expansion tool 56.

Finally fluid is pumped through the tubular running string 46 into the space formed between the packer 50 and the cone expander 54 thereby moving the cone expander 54 upwardly through the liner 2 so as to further expand the liner 2.

It will be understood that in this detailed example the assembly according to the invention enables setting of the packer 50 in the liner 2 by virtue of the feature that the EST 3 has been firmly expanded against the wellbore wall and thereby prevents rotation of the liner 2 during setting of the packer 50.

Instead of applying the assembly 1 in the wellbore 40, any one of the assemblies 20 discussed hereinbefore with reference to FIGS. 2A, 2B, 3A, 3B, 4A, 4B, 5A, 5B can be applied in the wellbore 40.

In accordance with one embodiment of the invention there is provided an assembly for use in a wellbore formed in an earth formation, comprising an expandable tubular element and an outer structure having first and second portions arranged at a distance from each other, said portions being restrained to the tubular element in a manner that said distance changes as a result of radial expansion of the tubular element, the outer structure further having a third portion arranged to move radially outward upon said change in distance between the first and second portions, wherein said radially outward movement of the third portion is larger than radially outward movement of the tubular element as a result of radial expansion of the tubular element.

In this manner it may be achieved that, by radially expanding the tubular element, the third portion of the outer structure is moved radially outward over a larger distance than the wall of the tubular element, thereby locally providing an increased expansion diameter.

Suitably the third portion is arranged to move radially outward as a result of a decrease in distance between the first and second portions.

By allowing the third portion to move radially outward by bending, the application of hinges in the outer structure can be avoided.

In a preferred embodiment the tubular element is susceptible of axial shortening upon radial expansion thereof, and said first and second portions of the outer structure are connected to the tubular element at respective locations axially spaced from each other. Furthermore, the first and second portions of the outer structure suitably can be welded to the tubular element at said respective locations axially spaced from each other.

Suitably said tubular element is an inner tubular element and the outer structure is an outer expandable tubular element arranged around the inner tubular element, and wherein the outer tubular element, when unrestrained from the inner tubular element, is susceptible to less axial shortening as a result of radial expansion than the inner tubular element. To create a wellbore packer, an annular space is suitably formed between the inner tubular element and the outer tubular element upon radial expansion of the inner tubular element, which space is filled with a fluidic compound, for example a hardenable fluidic compound. Optionally a flexible layer of sealing material can be arranged around the outer tubular element.

I claim:

1. An assembly for use in a wellbore formed in an earth formation, comprising:

an expandable tubular element and an outer structure having first and second portions arranged at a distance from each other, wherein the expandable tubular element shortens as a result of radial expansion thereof;

the first portion and the second portion of the outer structure being connected to the tubular element throughout radial expansion of the tubular element at respective locations axially spaced from each other such that the distance between the first and second portions changes during radial expansion of the tubular element between the first and second portions; and the outer structure further having a third portion arranged to move radially outward upon the change in distance between the first and second portions;

wherein the radially outward movement of the third portion is larger than the radially outward movement of the tubular element that results from radial expansion of the tubular element.

2. The assembly of claim 1, wherein the third portion is arranged to move radially outward as a result of a decrease in distance between the first portion and the second portions.

3. The assembly of claim 1, wherein the third portion is arranged to move radially outward by virtue of radially outward bending of the third portion.

4. The assembly of claim 1, wherein the first portion and the second portion of the outer structure are welded to the tubular element at respective locations axially spaced from each other.

5. The assembly of claim 1, wherein the tubular element is an inner tubular element and the outer structure is an outer expandable tubular element arranged around the inner tubular element, and wherein the outer tubular element, when unrestrained from the inner tubular element, is susceptible to less axial shortening as a result of radial expansion than the inner tubular element.

6. The assembly of claim 5, wherein the outer tubular element is provided with a plurality of openings in the wall thereof, said openings overlapping each other in the axial direction.

7. The assembly of claim 6, wherein said openings are slots provided in the wall of the outer expandable tubular element, the slots extending in substantially in the axial direction.

8. The assembly of claim 5, wherein the first portion and the second portion are respective end portions of the outer tubular element.

9. The assembly of claim 5, wherein an annular space is formed between the inner tubular element and the outer tubular element upon radial expansion of the inner tubular element, said space being filled with a fluidic compound.

10. The assembly of claim 9, wherein said space is filled with a hardenable fluidic compound.

11. The assembly of claim 1, wherein the outer structure includes at least one elongate member extending in the axial direction of the tubular element.

12. The assembly of claim 11, wherein the outer structure includes a plurality of said elongate members regularly spaced along the circumference of the tubular element.

13. The assembly of claim 12, wherein each of said elongate members is a metal bar.

* * * * *